US011078014B2

(12) United States Patent
McCaffrey

(10) Patent No.: US 11,078,014 B2
(45) Date of Patent: Aug. 3, 2021

(54) RECYCLABLES DISPENSING ASSEMBLY

(71) Applicant: Mike McCaffrey, Victoria (CA)

(72) Inventor: Mike McCaffrey, Victoria (CA)

( * ) Notice: Subject to any disclaimer, the term of this patent is extended or adjusted under 35 U.S.C. 154(b) by 783 days.

(21) Appl. No.: 15/948,703

(22) Filed: Apr. 9, 2018

(65) Prior Publication Data

US 2019/0308809 A1 Oct. 10, 2019

(51) Int. Cl.

| | |
|---|---|
| ***B65F 1/12*** | (2006.01) |
| ***B65F 1/14*** | (2006.01) |
| ***B65D 43/22*** | (2006.01) |
| *B65F 1/16* | (2006.01) |

(52) U.S. Cl.

CPC ..... *B65F 1/12* (2013.01); *B65D 43/22* (2013.01); *B65F 1/1415* (2013.01); *B65F 2001/1669* (2013.01); *B65F 2210/18* (2013.01)

(58) Field of Classification Search

CPC ..... B65F 1/1415; B65F 1/141; B65F 1/16; B65F 1/125; B65F 1/12; B65D 25/22; B65D 11/1866; B65D 11/1873; B65D 43/16; B65D 43/22; B65D 45/16

USPC ..... 220/833, 810, 326, 324, 315, 481, 480, 220/4.33, 4.28; 221/90, 89; D34/6

See application file for complete search history.

(56) References Cited

U.S. PATENT DOCUMENTS 1,019,347 A * 3/1912 Nickerson ..... B65D 45/16 220/326
2,602,584 A * 7/1952 Croft, Jr. ..... B65F 1/141 232/43.1
2,690,274 A * 9/1954 Thurston ..... B65F 1/12 220/326
2,726,035 A * 12/1955 Meissner ..... B65F 1/02 232/43.1
3,075,692 A 1/1963 Lumley
3,144,166 A * 8/1964 Cross, Jr. ..... B65D 45/16 220/326
3,563,452 A * 2/1971 Cantella ..... B65F 1/141 232/43.2
3,749,302 A * 7/1973 White ..... A47G 29/12 232/19
4,217,073 A 4/1980 Propst
4,694,503 A 9/1987 Hydom
D326,173 S 5/1992 Newbold
5,263,602 A 11/1993 Lathouris
D359,606 S 6/1995 Holland
5,647,502 A 7/1997 Marsh
6,616,109 B1 9/2003 Jarrett et al.
7,108,150 B1 9/2006 Rouse
D825,878 S * 8/2018 Lewis ..... D34/7

* cited by examiner

*Primary Examiner* — Robert J Hicks

(57) ABSTRACT

A recyclables dispensing assembly includes a plurality of panels that are releasably coupled together to form a box for storing recyclables. The box is mounted on a vertical support surface. A door is hingedly coupled to a respective one of the panels such that the door closes a bottom end of the box when the panels are assembled to form the box. Thus, the door retains the recyclables in the box. The door is selectively positioned in an open position to empty the recyclables from the box. A clasp is attached to a respective one of the panels and the clasp is biased to engage the door when the door is closed. The clasp is urgeable to disengage from the door to open the door.

7 Claims, 8 Drawing Sheets

RECYCLABLES DISPENSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispensing devices and more particularly pertains to a new dispensing device for storing and dispensing recyclables.

BRIEF SUMMARY OF THE INVENTION

An embodiment of the disclosure meets the needs presented above by generally comprising a plurality of panels that are releasably coupled together to form a box for storing recyclables. The box is mounted on a vertical support surface. A door is hingedly coupled to a respective one of the panels such that the door closes a bottom end of the box when the panels are assembled to form the box. Thus, the door retains the recyclables in the box. The door is selectively positioned in an open position to empty the recyclables from the box. A clasp is attached to a respective one of the panels and the clasp is biased to engage the door when the door is closed. The clasp is urgeable to disengage from the door to open the door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
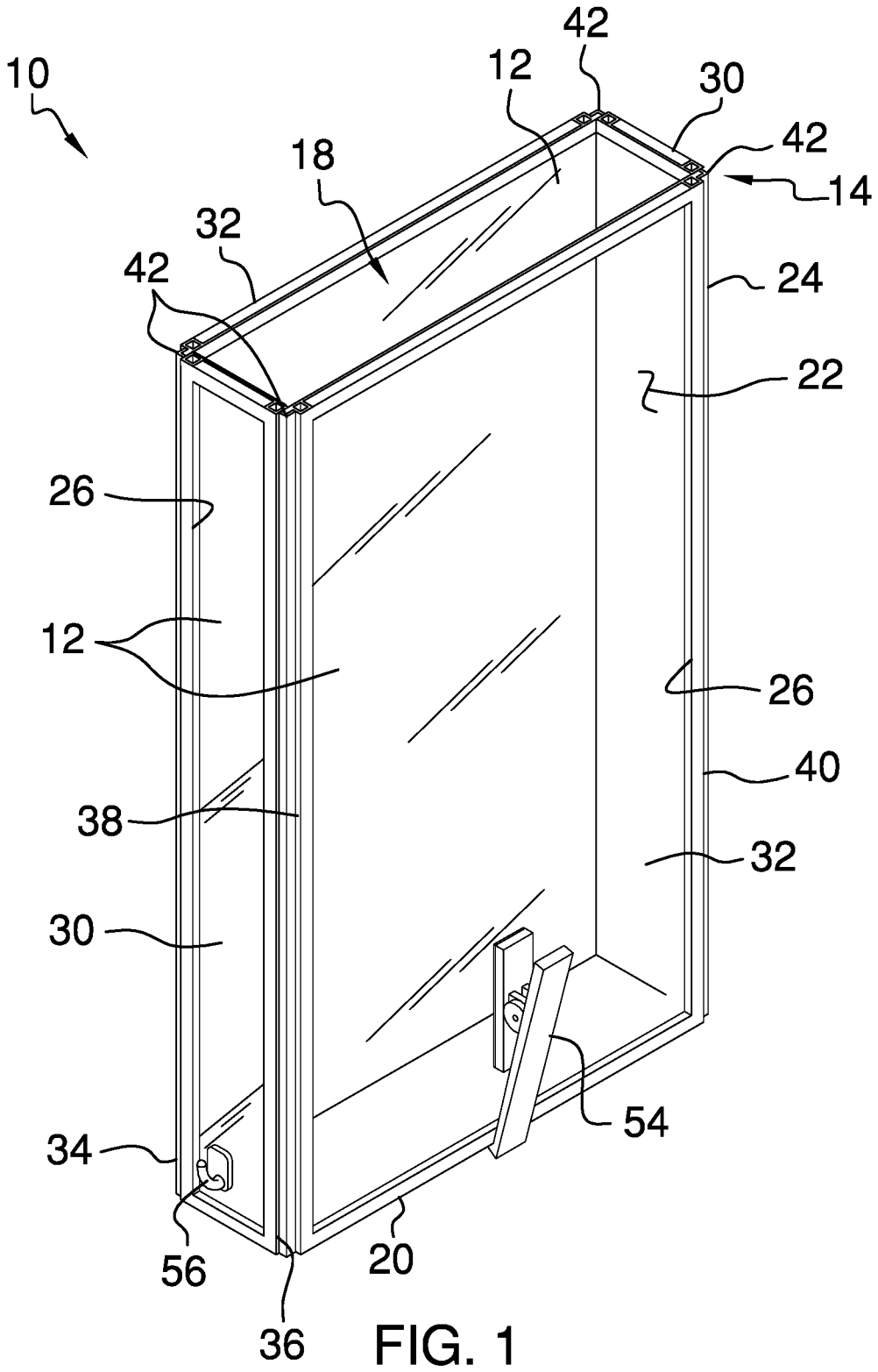
FIG. 1 is a front perspective view of a recyclables dispensing assembly according to an embodiment of the disclosure.
Figure 2:
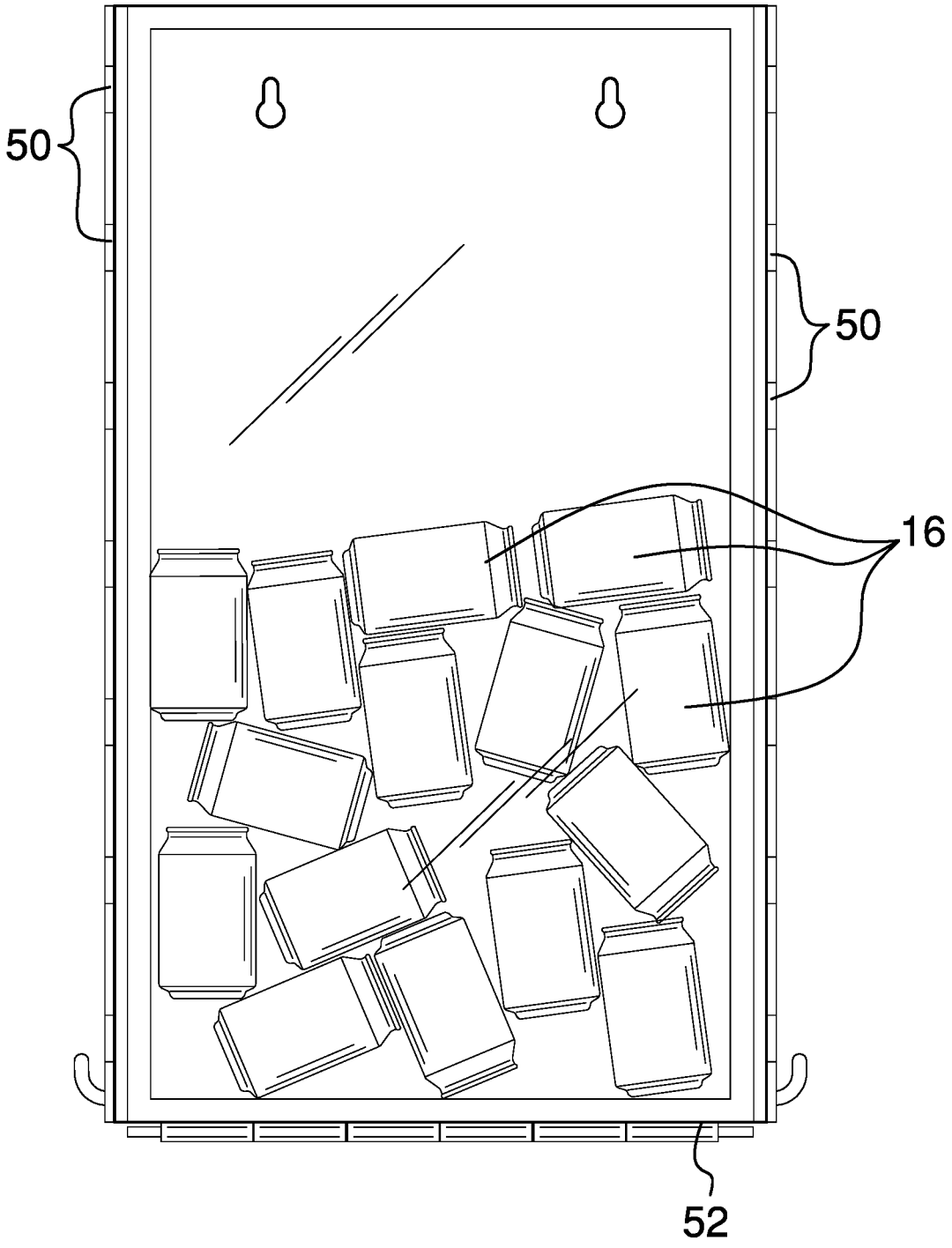
FIG. 2 is a back view of an embodiment of the disclosure.
Figure 3:
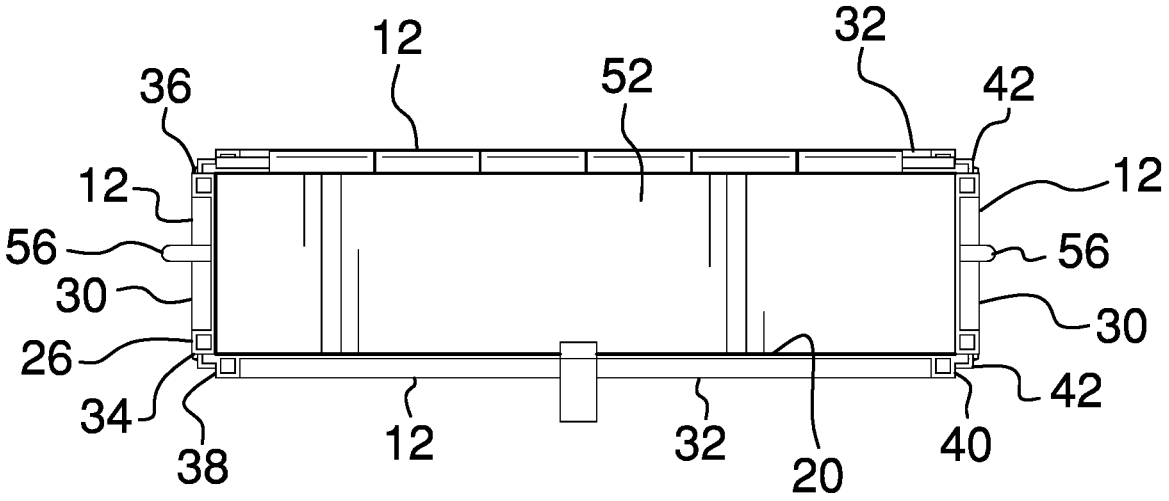
FIG. 3 is a bottom view of an embodiment of the disclosure.
Figure 4:
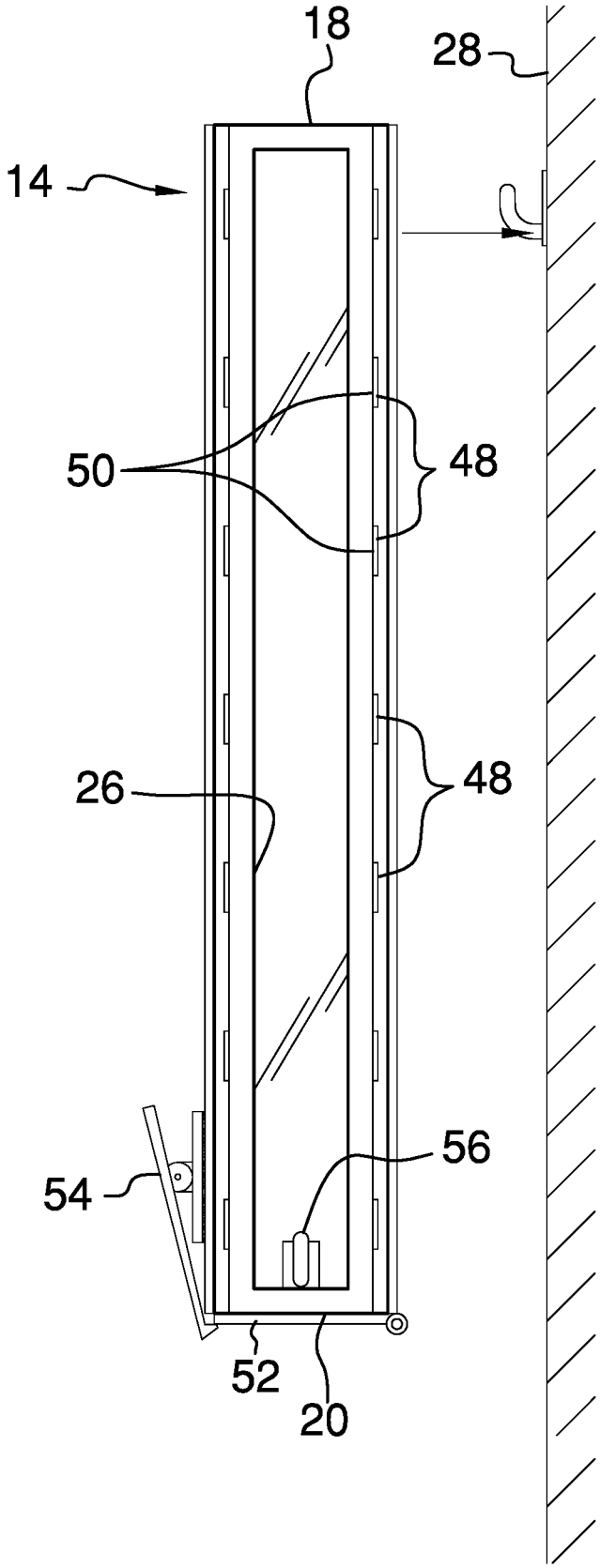
FIG. 4 is a left side view of an embodiment of the disclosure.
Figure 5:
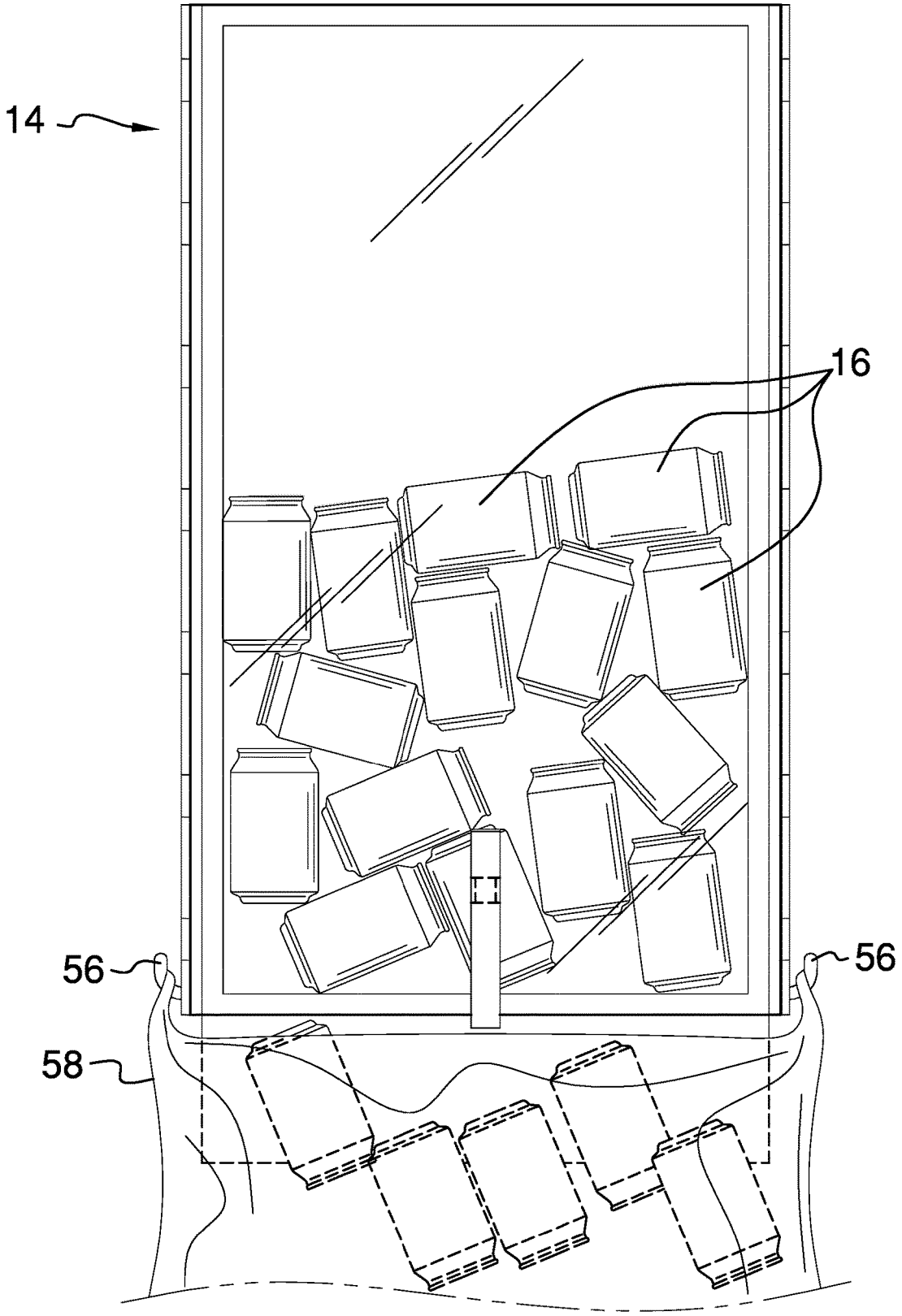
FIG. 5 is a front in-use view of an embodiment of the disclosure.
Figure 6:
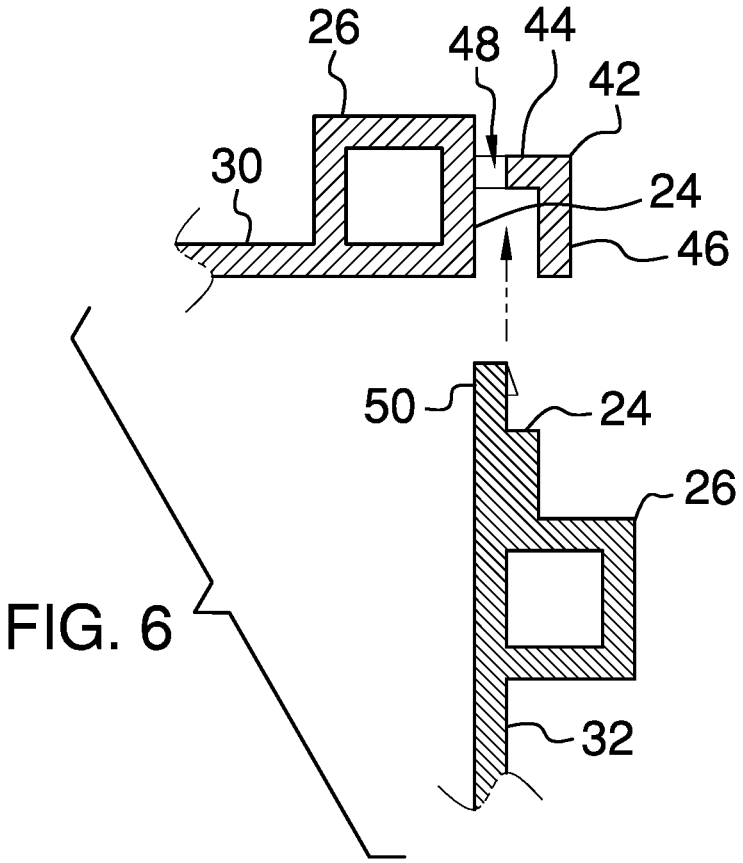
FIG. 6 is a top view of a lock being inserted into an engagement an embodiment of the disclosure.
Figure 7:
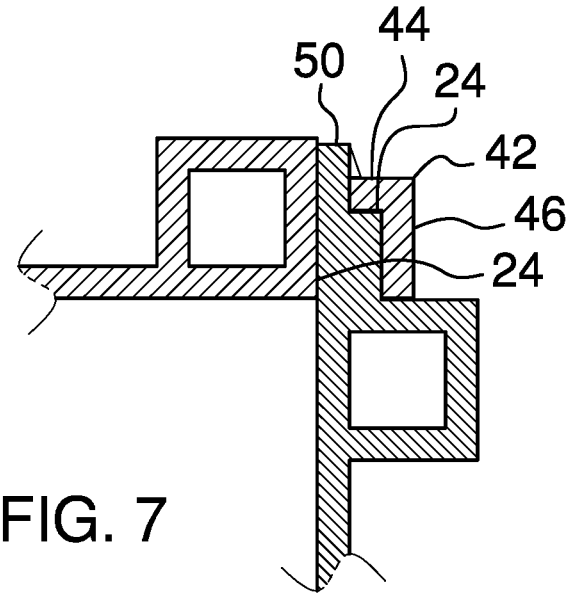
FIG. 7 is a top view of lock engaging an engagement of an embodiment of the disclosure.
Figure 8:
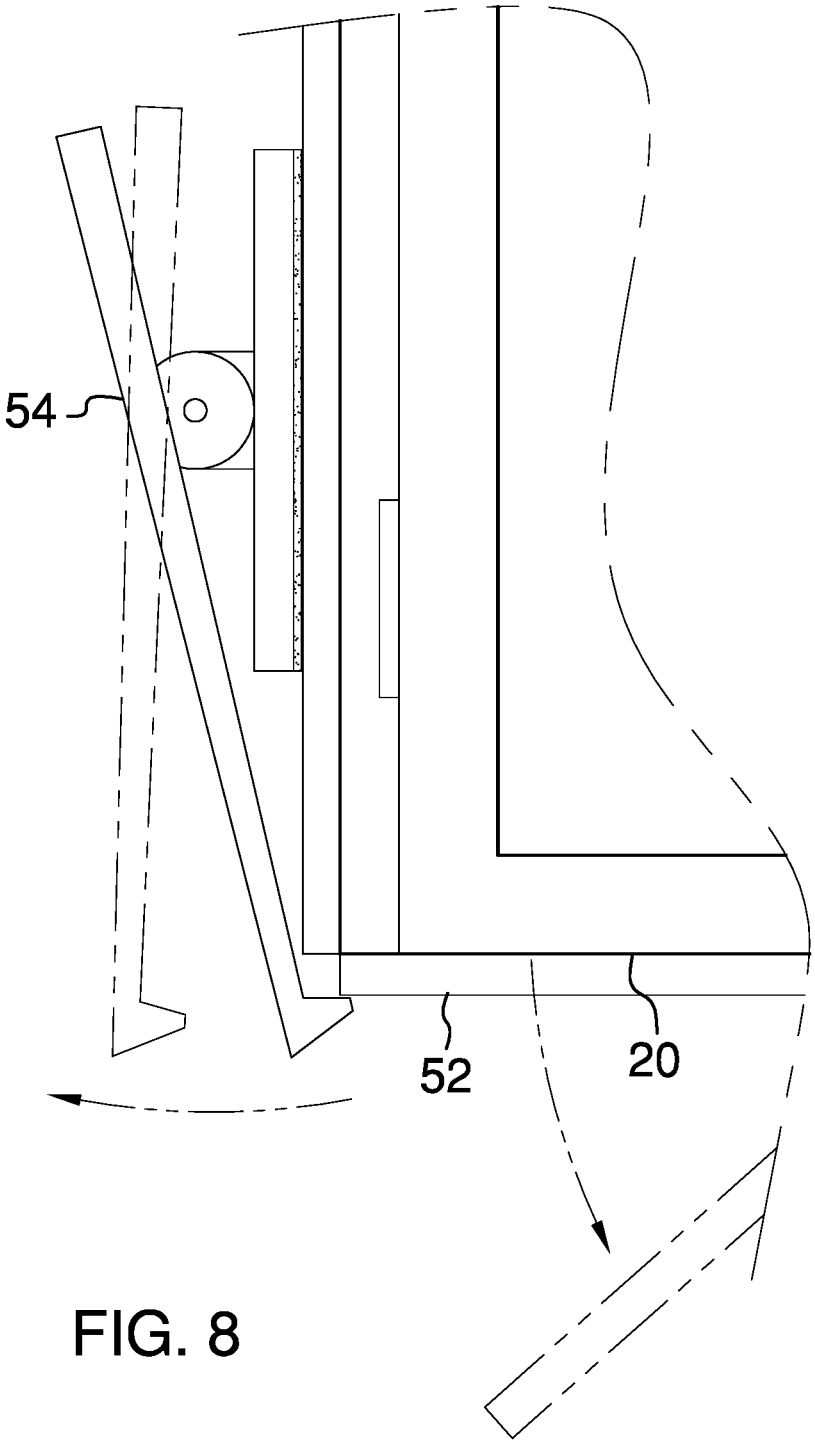
FIG. 8 is a perspective of a clasp being urged to disengage a door of an embodiment of the disclosure.

With reference now to the drawings, and in particular to FIGS. 1 through 9 thereof, a new dispensing device embodying the principles and concepts of an embodiment of the disclosure and generally designated by the reference numeral 10 will be described.

As best illustrated in FIGS. 1 through 9, the recyclables dispensing assembly 10 generally comprises a plurality of panels 12. Each of the panels 12 is releasably coupled together such that the plurality of panels 12 forms a box 14 for storing recyclables 16, such as aluminum cans or the like. The box 14 has a top end 18 and a bottom end 20, and each of the top end 18 and the bottom end 20 are open. Each of the panels 12 is comprised of a translucent material such that the recycles are visible in the box 14. Each of the panels 12 has a first surface 22 and a peripheral edge 24, and each of the panels 12 has a raised border 26 extending away from the first surface 22. The raised border 26 on each of the panels 12 is coextensive with the peripheral edge 24 and the box 14 is mounted on a vertical support surface 28, such as a wall in a room or the like.

The plurality of panels 12 includes a pair of first panels 30 and a pair of second panels 32. The peripheral edge 24 of each of the first panels 30 has a first lateral side 34 and a second lateral side 36. The peripheral edge 24 of each of the second panels 32 has a first outer side 38 and a second outer side 40. Moreover, each of the first panels 30 may have a width ranging between approximately 7.0 cm and 10.0 cm and each of the second panels 32 may have a width ranging between approximately 35.0 cm and 55.0 cm. Additionally, each of the first panels 30 and the second panels 32 may have a height ranging between approximately 60.0 cm and 80.0 cm.

A plurality of engagements 42 is included and each of the engagements 42 is attached to a respective one of the first lateral side 34 and the second lateral side 36 on a respective one of the first panels 30. Each of the engagements 42 insertably receives a respective one of the first outer side 38 and the second outer side 40 of a respective one of the second panels 32. Additionally, each of the engagements 42 comprises a leg 44 that extends laterally away from and is coextensive with the respective first or second lateral side 36*s* on the respective first panel. Each of the engagements 42 comprises a foot 46 extending away from the leg 44 such that the foot 46 of each of the engagements 42 is spaced from the respective first 34 or second 36 lateral edges on the respective first panel. The leg 44 of each of the engagements 42 has a plurality of apertures 48 extending therethrough and the apertures 48 on the leg 44 of each engagement are spaced apart from each other and are distributed along the leg 44.

A plurality of locks 50 is provided and each of the locks 50 is attached to and extends laterally away from a respective one of the first outer side 38 and the second outer side 40 of a respective one of the second panels 32. Each of the locks 50 is extended through a respective one of the apertures 48 in a respective one of the engagements 42 when the plurality of panels 12 is releasably coupled together to form the box 14. Moreover, each of the locks 50 releasably engages the respective engagement 42 when the locks 50 are extended through the respective aperture 48. Thus, the locks 50 are inhibited from being removed from the respective aperture 48. Each of the locks 50 may include a spring loaded latch or the like that can be manually disengaged to release the respective engagement 42. In this way the box 14 may be disassembled into the plurality of panels 12.

A door 52 is hingedly coupled to a respective one of the panels 12. The door 52 closes the bottom end 20 of the box 14 when the panels 12 are assembled to form the box 14. In this way the door 52 retains the recyclables 16 in the box 14. The door 52 is selectively positioned in an open position to empty the recyclables 16 from the box 14. A clasp 54 is attached to a respective one of the panels 12 and the clasp 54 engages the door 52 when the door 52 is in a closed position. The clasp 54 may include a spring loaded arm or the like that is biased to engage the door 52. The clasp 54 is urgeable to disengage the door 52, thereby facilitating the door 52 to be opened.

Figure 9:
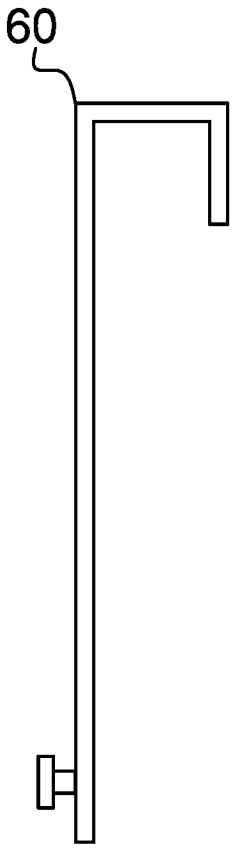
FIG. 9 is a perspective view of a hook of an embodiment of the disclosure.

A pair of supports 56 is provided and each of the supports 56 is coupled to the first surface 22 of a respective one of the first panels 30. Each of the supports 56 engages a garbage bag 58 or the like to suspend the garbage bag 58 beneath the box 14 for receiving the recyclables 16 when the door 52 is opened. Additionally, each of the supports 56 may comprise a hook or the like that extends away from the respective first panel 30. As shown in FIG. 9, at least one hook 60 may be provided and the at least one hook 60 may be positioned over a top edge of a door or the like. Moreover, the box 14 may engage the at least one hook 60 thereby suspending the box 14 on the door.

In use, the panels 12 are assembled to form the box 14 and the box 14 is mounted on the vertical support surface 28. The recyclables 16 are placed into the box 14 for storage until the box 14 becomes filled with the recyclables 16. The garbage bag 58 is suspended from the supports 56 and the clasp 54 is manipulated to open the door 52. Thus, the recyclables 16 fall out of the box 14 and into the garbage bag 58. The door 52 is closed and the clasp 54 engages the door 52, thereby facilitating the box 14 to be filled again with the recyclables 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A recyclables dispensing assembly being configured to store recyclables thereby facilitating the recyclables to be selectively dispensed into a garbage bag, said assembly comprising:

a plurality of panels, each of said panels being releasably coupled together having said plurality of panels forming a box wherein said plurality of panels is configured to store recyclables, said box being mounted on a vertical support surface;

a door being hingedly coupled to a respective one of said panels such that said door closes a bottom end of said box when said panels are assembled to form said box wherein said door is configured to retain the recyclables in said box, said door being selectively positioned in an open position wherein said door is configured to empty the recyclables from said box; and a clasp being attached to a respective one of said panels, said clasp being biased to engage said door when said door is closed, said clasp being urgeable to disengage from said door to open said door.

2. The assembly according to claim 1, wherein each of said panels has a first surface and a peripheral edge, each of said panels having a raised border extending away from said first surface, said raised border on each of said panels being coextensive with said peripheral edge, said plurality of panels including a pair of first panels and a pair of second panels, said peripheral edge of each of said first panels having a first lateral side and a second lateral side, said peripheral edge of each of said second panels having a first outer side and a second outer side.

3. The assembly according to claim 2, further comprising a plurality of engagements, each of said engagements being attached to a respective one of said first lateral side and said second lateral side on a respective one of said first panels, each of said engagements insertably receiving a respective one of said first outer side and said second outer side of a respective one of said second panels, each of said engagements having a plurality of apertures therein.

4. The assembly according to claim 3, wherein each of said engagements comprises a leg extending laterally away from and being coextensive with said respective first or second lateral sides on said respective first panel, each of said engagements comprising a foot extending away from said leg such that said foot of each of said engagements is spaced from said respective first or second lateral sides on said respective first panel.

5. The assembly according to claim 4, wherein said leg of each of said engagements has respective ones of said plurality of apertures extending therethrough, said apertures in each of said engagements being spaced apart from each other and being distributed along said leg.

6. The assembly according to claim 3, further comprising a plurality of locks, each of said locks being attached to a respective one of said first outer side and said second outer side of a respective one of said second panels, each of said locks being extended through a respective one of said apertures in a respective one of said engagements when said plurality of panels is releasably coupled together to form said box, each of said locks releasably engaging said respective engagement when said locks are extended through said respective aperture to inhibit said locks from being removed from said respective aperture.

7. A recyclables dispensing assembly being configured to store recyclables thereby facilitating the recyclables to be selectively dispensed into a garbage bag, said assembly comprising:

a plurality of panels, each of said panels being releasably coupled together having said plurality of panels forming a box wherein said plurality of panels is configured to store recyclables, each of said panels having a first surface and a peripheral edge, each of said panels having a raised border extending away from said first surface, said raised border on each of said panels being coextensive with said peripheral edge, said box being mounted on a vertical support surface, said plurality of panels including a pair of first panels and a pair of second panels, said peripheral edge of each of said first panels having a first lateral side and a second lateral side, said peripheral edge of each of said second panels having a first outer side and a second outer side;

a plurality of engagements, each of said engagements being attached to a respective one of said first lateral side and said second lateral side on a respective one of said first panels, each of said engagements insertably receiving a respective one of said first outer side and said second outer side of a respective one of said second panels, each of said engagements comprising a leg extending laterally away from and being coextensive with said respective first or second lateral sides on said respective first panel, each of said engagements comprising a foot extending away from said leg such that said foot of each of said engagements is spaced from said respective first or second lateral sides on said respective first panel, said leg of each of said engagements having a plurality of apertures extending therethrough, said apertures being spaced apart from each other and being distributed along said leg;

a plurality of locks, each of said locks being attached to a respective one of said first outer side and said second outer side of a respective one of said second panels, each of said locks being extended through a respective one of said apertures in a respective one of said engagements when said plurality of panels is releasably coupled together to form said box, each of said locks releasably engaging said respective engagement when said locks are extended through said respective aperture to inhibit said locks from being removed from said respective aperture;

a door being hingedly coupled to a respective one of said panels such that said door closes a bottom end of said box when said panels are assembled to form said box wherein said door is configured to retain the recyclables in said box, said door being selectively positioned in an open position wherein said door is configured to empty the recyclables from said box; and a clasp being attached to a respective one of said panels, said clasp being biased to engage said door when said door is closed, said clasp being urgeable to disengage from said door to open said door.

* * * * *